US011001349B1

(12) United States Patent
Hisada et al.

(10) Patent No.: US 11,001,349 B1
(45) Date of Patent: May 11, 2021

(54) PERSONAL WATERCRAFT

(71) Applicant: KAWASAKI JUKOGYO KABUSHIKI KAISHA, Kobe (JP)

(72) Inventors: Kazumasa Hisada, Akashi (JP); Hironori Kato, Kakogawa (JP); Toshio Araki, Kakogawa (JP); Masaaki Miyoshi, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/730,098

(22) Filed: Dec. 30, 2019

(51) Int. Cl.
*B63B 34/10* (2020.01)

(52) U.S. Cl.
CPC ..... *B63B 34/10* (2020.02)

(58) Field of Classification Search
CPC ..... B63B 34/00; B63B 34/10; B63B 19/12; B63B 19/14; B63B 19/24; B63B 19/26; B63B 19/28; B63B 2019/245; B63B 3/54
USPC ..... 114/55.5, 55.51, 55.53, 178, 201 R, 203, 114/343, 361, 364
See application file for complete search history.

(56) References Cited

U.S. PATENT DOCUMENTS 5,490,474 A * 2/1996 Ikeda ..... B63B 34/10 114/343
5,588,887 A * 12/1996 Ikeda ..... B63B 34/10 440/88 L
5,619,950 A * 4/1997 Ikeda ..... B63B 34/10 114/363
6,308,650 B1 10/2001 Tsumiyama et al.

* cited by examiner

*Primary Examiner* — Daniel V Venne
(74) *Attorney, Agent, or Firm* — Alleman Hall Creasman & Tuttle LLP

(57) ABSTRACT

A personal watercraft includes: a watercraft body including an internal accommodation space and a front portion provided with an opening through which the accommodation space is open upward, the watercraft body further including a baffle portion and a recessed portion, the baffle portion being spaced at least forward from a peripheral portion of the opening and projecting upward, the recessed portion being formed between the peripheral portion and the baffle portion; a hatch cover including a closing portion and an overhanging portion extending at least forward from the closing portion to cover the recessed portion and the baffle portion; a first sealing member configured to seal a gap between the peripheral portion of the opening and the hatch cover when the hatch cover is in a closed state; and a second sealing member configured to seal a gap between the overhanging portion and the baffle portion.

9 Claims, 9 Drawing Sheets

PERSONAL WATERCRAFT

BACKGROUND OF THE INVENTION

1. Field of the Invention

The present disclosure relates to a personal watercraft configured to plane on water by jetting water rearward from a water jet pump.

2. Description of the Related Art

Personal watercrafts (PWCs) are widely used for leisure, sports, and rescue activities. In a common personal watercraft, water drawn through a water inlet port provided in a bottom surface of the body of the watercraft is pressurized and accelerated by a water jet pump driven by the engine of the watercraft, and the water is jetted rearward to propel the body of the watercraft.

The body of a watercraft has an opening provided in a front portion thereof and located forward of the handle of the watercraft, and an accommodation space inside the body of the watercraft can be open upward through this opening. The opening is closable by a hatch cover. The hatch cover is coupled to the body of the watercraft via a hinge device so as to be movable to open and close the opening. When the hatch cover is in a closed state, the gap between the periphery of the opening of the body of the watercraft and the hatch cover is sealed with a sealing member.

The hatch cover has a larger area than the opening of the body of the watercraft. For design reasons and other reasons, the hatch cover may include an overhanging portion extending forward significantly beyond the sealing member. In this case, if the front portion of the body of the watercraft violently plunges into water, the lower surface of the overhanging portion is smashed against the water and exposed to high water pressure. This causes a strong upward stress acting on the overhanging portion of the hatch cover restrained by the hinge device, thus increasing the likelihood of local deterioration of the hatch cover.

SUMMARY OF THE INVENTION

The present disclosure is directed to a personal watercraft that includes a hatch cover configured to be placed over and close an opening of a front portion of the body of the watercraft and including an overhanging portion extending at least forward, and an object of the present disclosure is to prevent local deterioration of the hatch cover.

A personal watercraft according to one aspect of the present disclosure includes: a watercraft body including an internal accommodation space and a front portion provided with an opening through which the accommodation space is open upward, the watercraft body further including a baffle portion and a recessed portion, the baffle portion being spaced at least forward from a peripheral portion of the opening and projecting upward, the recessed portion being formed between the peripheral portion and the baffle portion; a hatch cover including a closing portion configured to be placed over and close the opening and an overhanging portion extending at least forward from the closing portion to cover the recessed portion and the baffle portion from above; a hinge device coupling the hatch cover to the watercraft body so that the hatch cover is movable to open and close the opening; a first sealing member configured to seal a gap between the peripheral portion of the opening and the hatch cover when the hatch cover is in a closed state where the hatch cover closes the opening; and a second sealing member configured to seal a gap between the overhanging portion and the baffle portion when the hatch cover is in the closed state.

With the above configuration, for example, when the front portion of the watercraft body violently plunges into water, the water coming from the front can be pushed back by the baffle portion, and entry of the water into the recessed portion through the gap between the overhanging portion and the baffle portion can be prevented by the second sealing member. Hence, exposure of the lower surface of the overhanging portion to high water pressure can be prevented, and thus generation of a strong upward stress on the overhanging portion can be prevented. Consequently, local deterioration of the hatch cover including the overhanging portion extending at least forward can be prevented.

The above and further objects, features and advantages of the present disclosure will be more apparent from the following detailed description of preferred embodiments with reference to the accompanying drawings.

DETAILED DESCRIPTION OF THE EMBODIMENTS

Hereinafter, an embodiment will be described with reference to the drawings.

Figure 1:
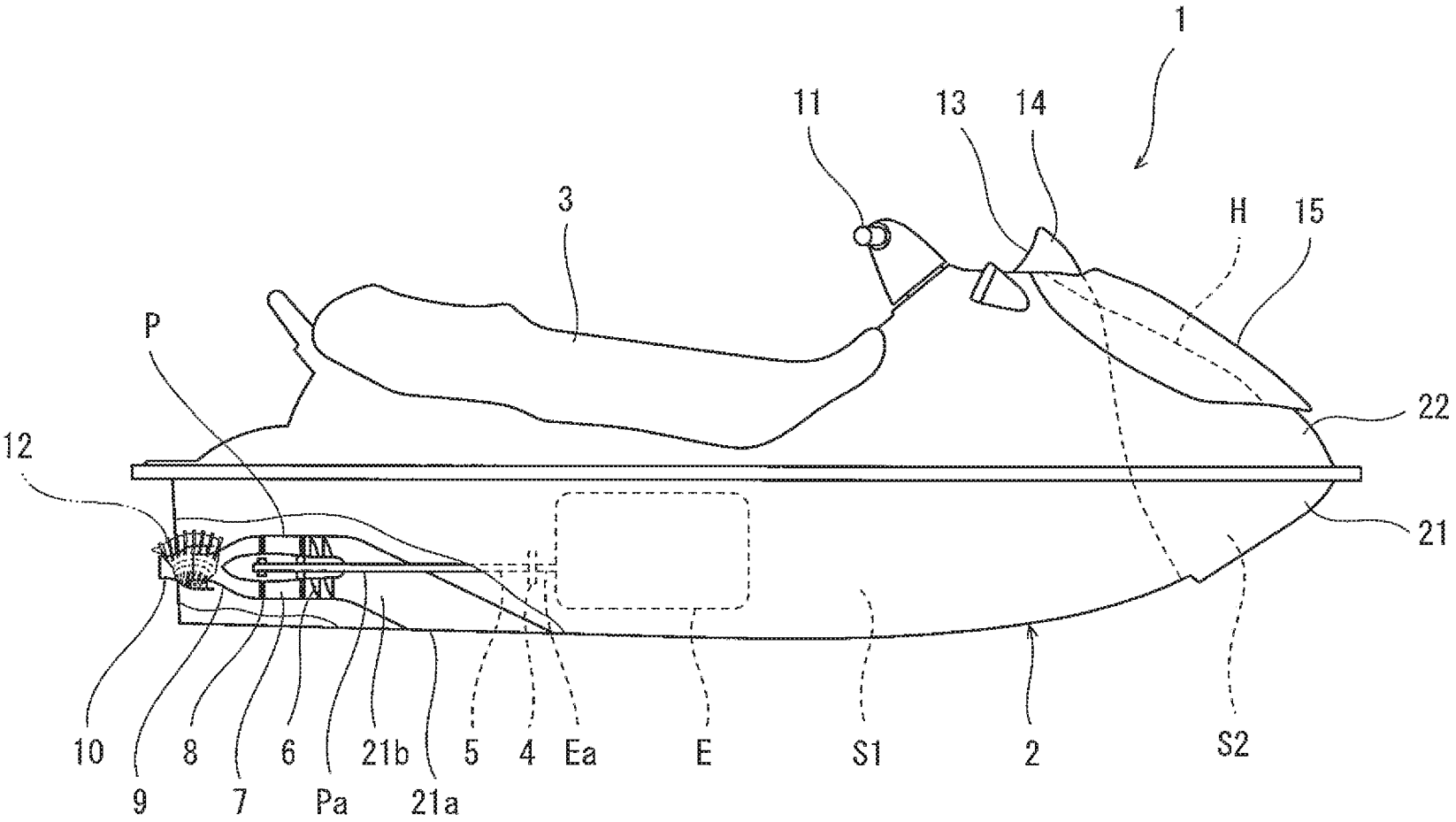
FIG. 1 is a partially cutaway side view of a personal watercraft according to an embodiment.

FIG. 1 is a partially cutaway side view of a personal watercraft 1 according to the embodiment. As shown in FIG. 1, the personal watercraft 1 includes a watercraft body 2. The watercraft body 2 includes a hull 21 and a deck 22 covering the top of the hull 21. The deck 22 is provided with a seat 3 on which the rider sits in a straddling position. The interior of the watercraft body 2 includes an engine accommodation space S1 and a front accommodation space S2 disposed forward of the engine accommodation space S1. The engine accommodation space S1 accommodates an engine E as a prime mover. The front accommodation space S2 can accommodate, for example, the user's possessions.

The engine E includes an output shaft Ea, which extends toward the rear of the watercraft body 2. The output end of the output shaft Ea is connected to a propeller shaft 5 via a coupling member 4. A water jet pump P is disposed in a rear portion of the hull 21, and the water jet pump P is located at the center of the hull 21 in the leftward/rightward direction. The water jet pump P includes a pump shaft Pa, to which the propeller shaft 5 is connected. Thus, the pump shaft Pa rotates in conjunction with the rotation of the output shaft Ea. An impeller 6 is mounted on the pump shaft Pa, and a stator vane 7 is disposed rearward of the impeller 6. A pump casing 8 of tubular shape is provided around the outer periphery of the impeller 6 so as to enclose the impeller 6.

A water inlet port 21*a* opens at the bottom of the watercraft body 2. The water inlet port 21*a* is in communication with the pump casing 8 through a water inlet passage 21*b*. A pump nozzle 9 is provided in the rear portion of the watercraft body 2 and connected to the pump casing 8. The diameter of the pump nozzle 9 decreases from front to rear, and a jet orifice opens at the rear end of the pump nozzle 9. A steering nozzle 10 is connected to the jet orifice of the pump nozzle 9, and the steering nozzle 10 is swingable to the left and right.

In the personal watercraft 1, water drawn through the water inlet port 21*a* provided in the bottom of the hull 21 is pressurized and accelerated by rotational power of the impeller 6 of the water jet pump P driven by the engine E. The stream of water is conditioned by the stator vane 7 and vigorously discharged rearward through the jet orifice of the pump nozzle 9 and the steering nozzle 10. Thus, the personal watercraft 1 is propelled by a reaction force from the water jetted out from the water jet pump P through the steering nozzle 10.

A steering handle 11 to be held by the rider is disposed forward of the seat 3. The handle 11 is connected to the steering nozzle 10 by a steering cable (not illustrated). When the handle 11 is tilted to the left or right, the steering nozzle 10 swings to the left or right in conjunction with the tilt of the handle 1. A reverse bucket 12 for backward movement of the watercraft is disposed in the vicinity of the steering nozzle 10, and the reverse bucket 12 is swingable upward and downward.

Figure 2:
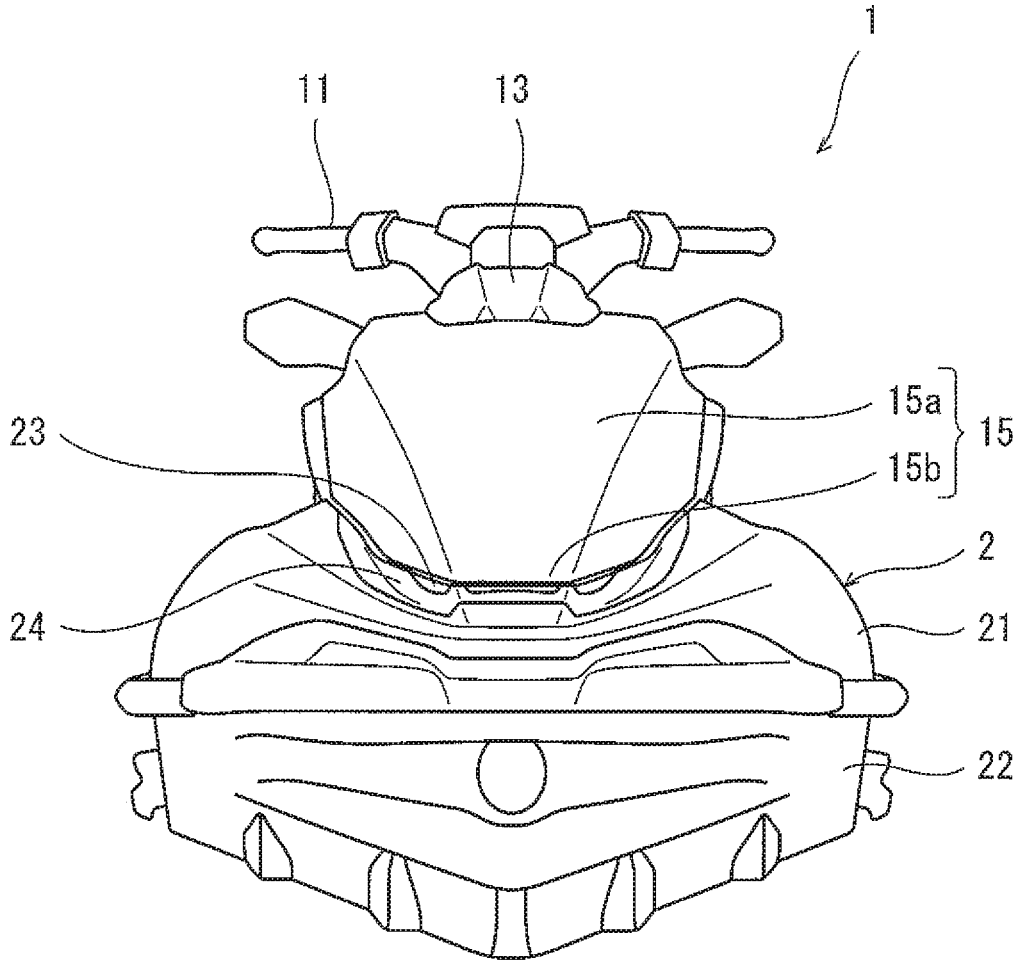
FIG. 2 is a front view of the personal watercraft shown in FIG. 1.
Figure 3:
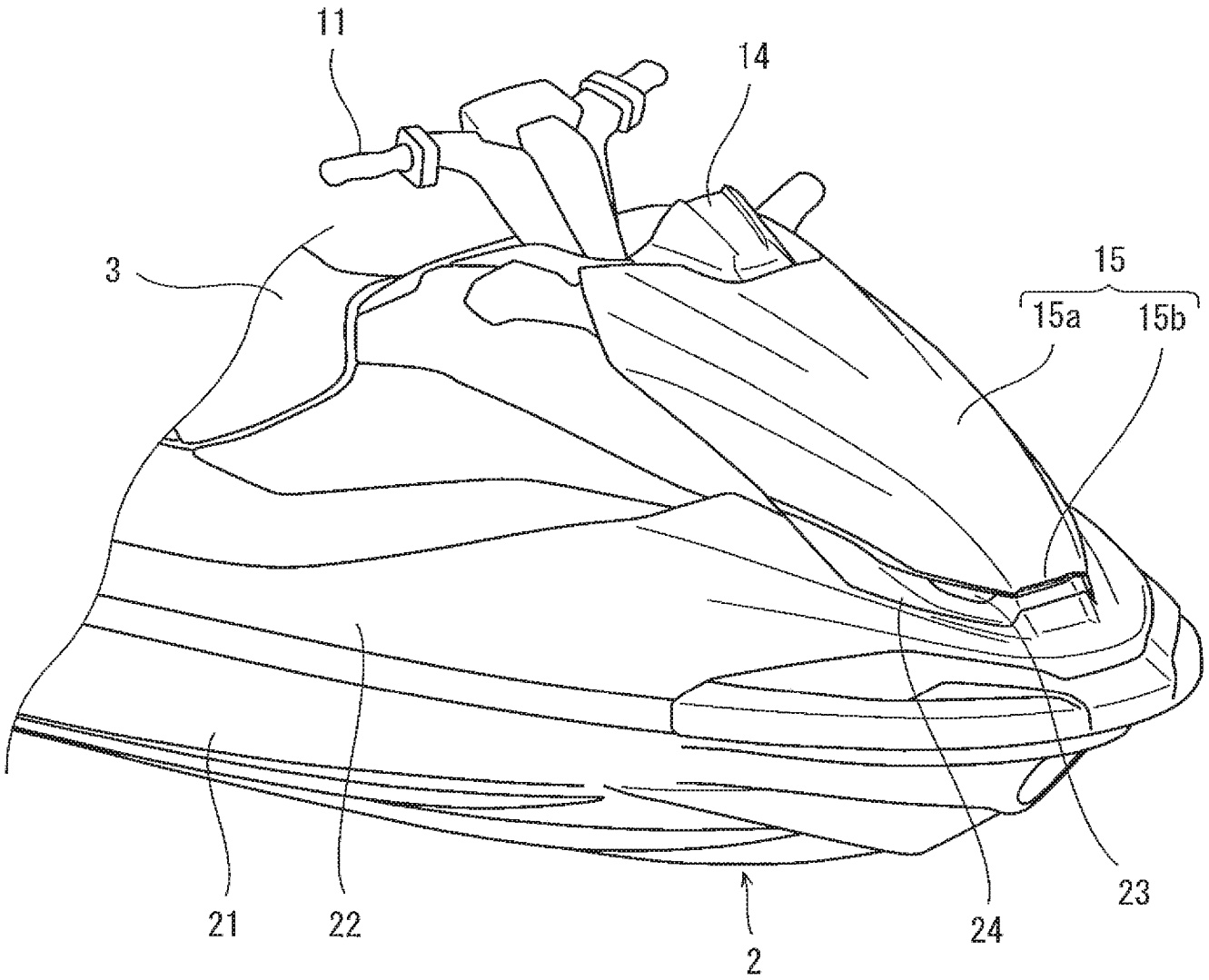
FIG. 3 is a right front perspective view of the front portion of the personal watercraft shown in FIG. 1.

FIG. 2 is a front view of the personal watercraft 1 shown in FIG. 1. FIG. 3 is a right front perspective view of the front portion of the personal watercraft 1 shown in FIG. 1. As shown in FIGS. 1 to 3, the front portion of the deck 22 is provided with an opening H through which the front accommodation space S2 formed within the watercraft body 2 is open upward. The deck 22 is provided with a meter display device 13 located rearward of the opening H and forward of the handle 11. The meter display device 13 is covered from above by the meter cover 14. A hatch cover 15 which closes the opening H from above is disposed forward of the meter cover 14, and the hatch cover 15 can be freely opened and closed.

Figure 4:
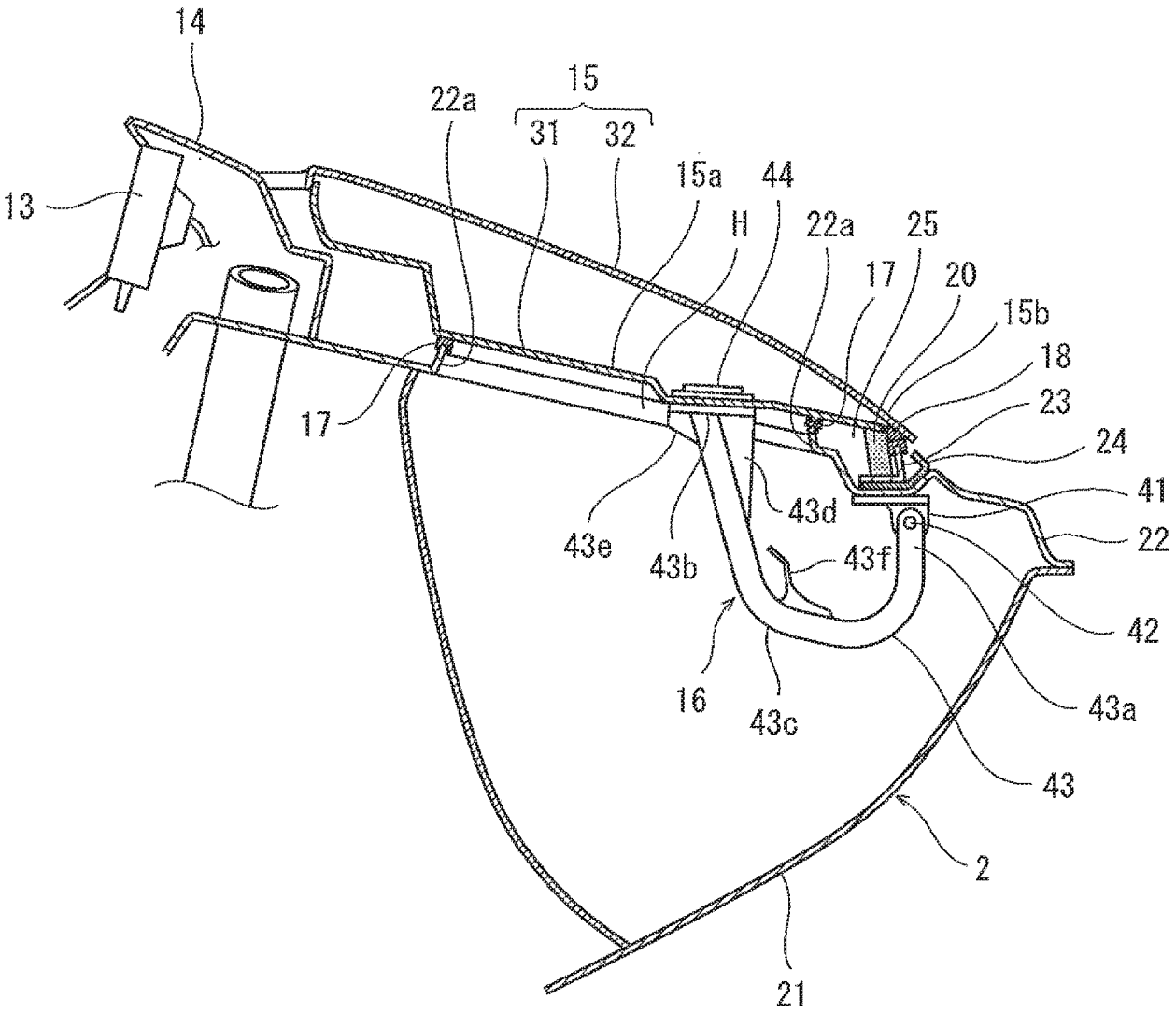
FIG. 4 is a longitudinal cross-sectional side view of the personal watercraft's front portion shown in FIG. 3.

FIG. 4 is a longitudinal cross-sectional side view of the personal watercraft 1's front portion shown in FIG. 3. As shown in FIG. 4, the hatch cover 15 is constituted by an inner panel 31 facing the opening H of the front portion of the deck 22 and an outer panel 32 placed over the inner panel 31 in such a manner that an internal space is formed between the inner panel 31 and the outer panel 32, the inner and outer panels 31 and 32 being assembled together. The hatch cover 15 includes a closing portion 15*a* configured to be placed over and close the opening H and an overhanging portion 15*b* extending forwardly and laterally from the closing portion 15*a*.

The inner panel 31 of the hatch cover 15 is provided with a first sealing member 17 configured to seal a gap between a peripheral portion 22*a* of the opening H and the hatch cover 15 when the hatch cover 15 is in a closed state where the hatch cover 15 closes the opening. The first sealing member 17 as viewed in plan has a ring shape which is approximately the same as the shape of the peripheral portion 22*a* of the opening H. The first sealing member 17 is made of an elastic material (e.g., rubber or silicone).

A hinge device 16 couples the hatch cover 15 to the deck 22 so that the hatch cover 15 is movable to open and close the opening H. The hinge device 16 is disposed in the front accommodation space S2 of the watercraft body 2. The hinge device 16 allows the hatch cover 15 to be opened in such a manner that the rear of the hatch cover 15 is moved obliquely upward and forward. The hinge device 16 includes a support member 41, a pivot member 42, an arm member 43, and a fixing member 44.

The support member 41 is fixed to a portion of the inner surface of the deck 22 which faces the front accommodation space S2, the portion of the inner surface being located forward of the opening H. The pivot member 42 is a shaft member pivotally supported by the support member 41. The arm member 43 includes a proximal end portion 43*a*, a distal end portion 43*b*, an arm portion 43*c*, gusset portions 43*d* and 43*e*, and a retainer portion 43*f*. The arm member 43 is formed integrally from a resin. The proximal end portion 43*a* is supported by the pivot member 42. The distal end portion 43*b* is attached to the closing portion 15*a* (or the inner panel 31 of the closing portion) of the hatch cover 15. The arm portion 43*c* extends from the proximal end portion 43*a* to the distal end portion 43*b* in the front accommodation space S2. The arm portion 43*c* is substantially U-shaped.

The distal end portion 43*b* projects forward and rearward from a portion of the arm portion 43*c* that is connected to the distal end portion 43*b*. The gusset portion 43*d* connects a forwardly facing surface of the arm portion 43*c* to the forwardly projecting portion of the distal end portion 43*b*, the forwardly facing surface being in the vicinity of the distal end portion 43*b*. The gusset portion 43*e* connects a rearwardly facing surface of the arm portion 43*c* to the rearwardly projecting portion of the distal end portion 43*b*, the rearwardly facing surface being in the vicinity of the distal end portion 43*b*. The front gusset portion 43*d* is larger than the rear gusset portion 43*e*, and the area over which the gusset portion 43*d* is connected to the forwardly facing surface of the arm portion 43*c* is wider than the area over which the gusset portion 43*e* is connected to the rearwardly facing surface of the arm portion 43*c*.

Figure 7:
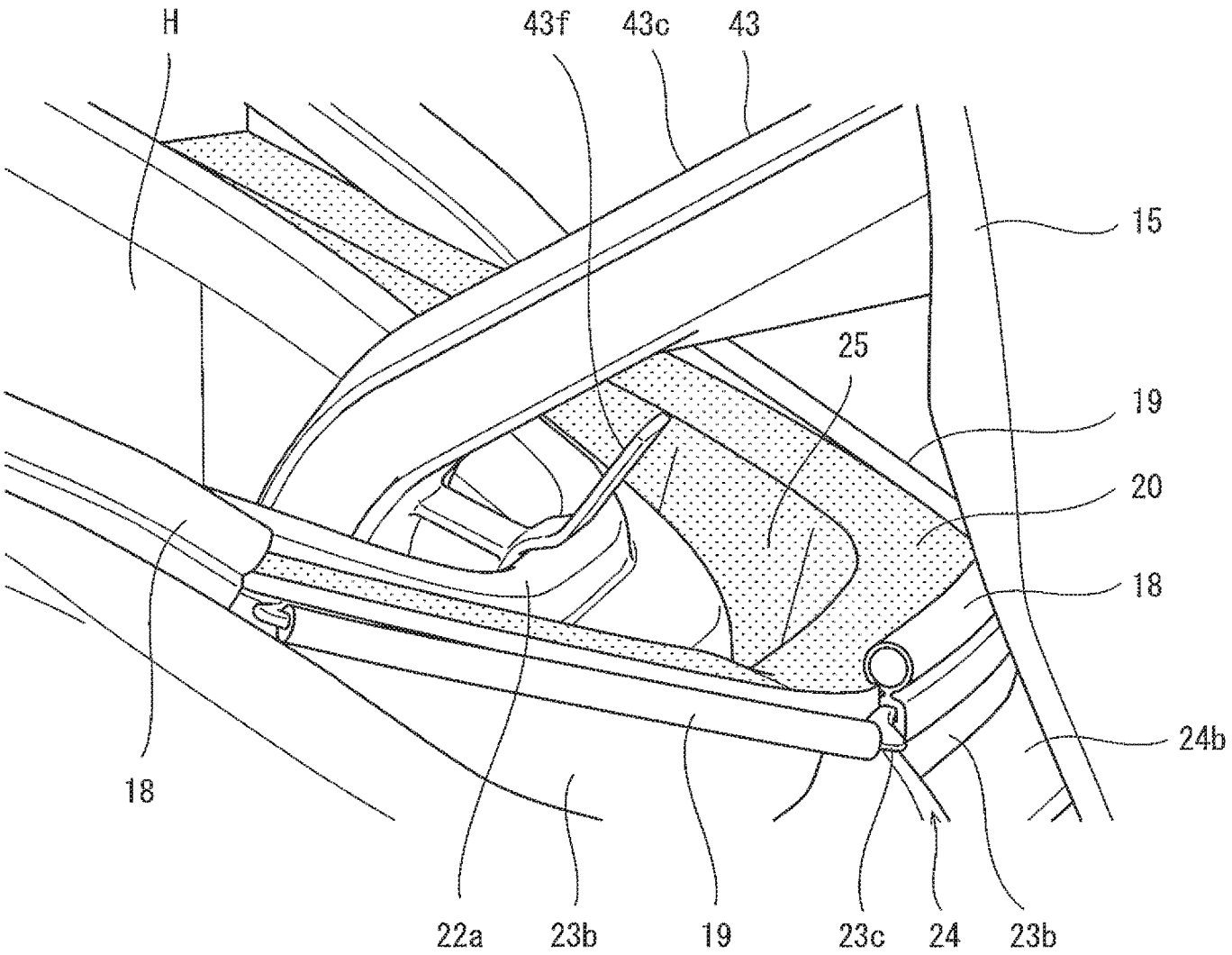
FIG. 7 is a perspective view of the personal watercraft shown in FIG. 6, with the second sealing members and filling member mounted.

When the hatch cover 15 is opened to a predetermined position, the retainer portion 43*f* is engaged with the peripheral portion 22*a* of the opening H of the deck 22 to keep the hatch cover 15 in the open state (see FIG. 7). The retainer portion 43*f* projects from the inner peripheral surface of the U-shaped arm portion 43*c*. The fixing member 44 fixes the distal end portion 43*b* of the arm member 43 to the closing portion 15*a* of the hatch cover 15. The hinge device 16 configured as described above enables the hatch cover 15 to pivot about the pivot member 42 to open and close the opening H.

Figure 5:
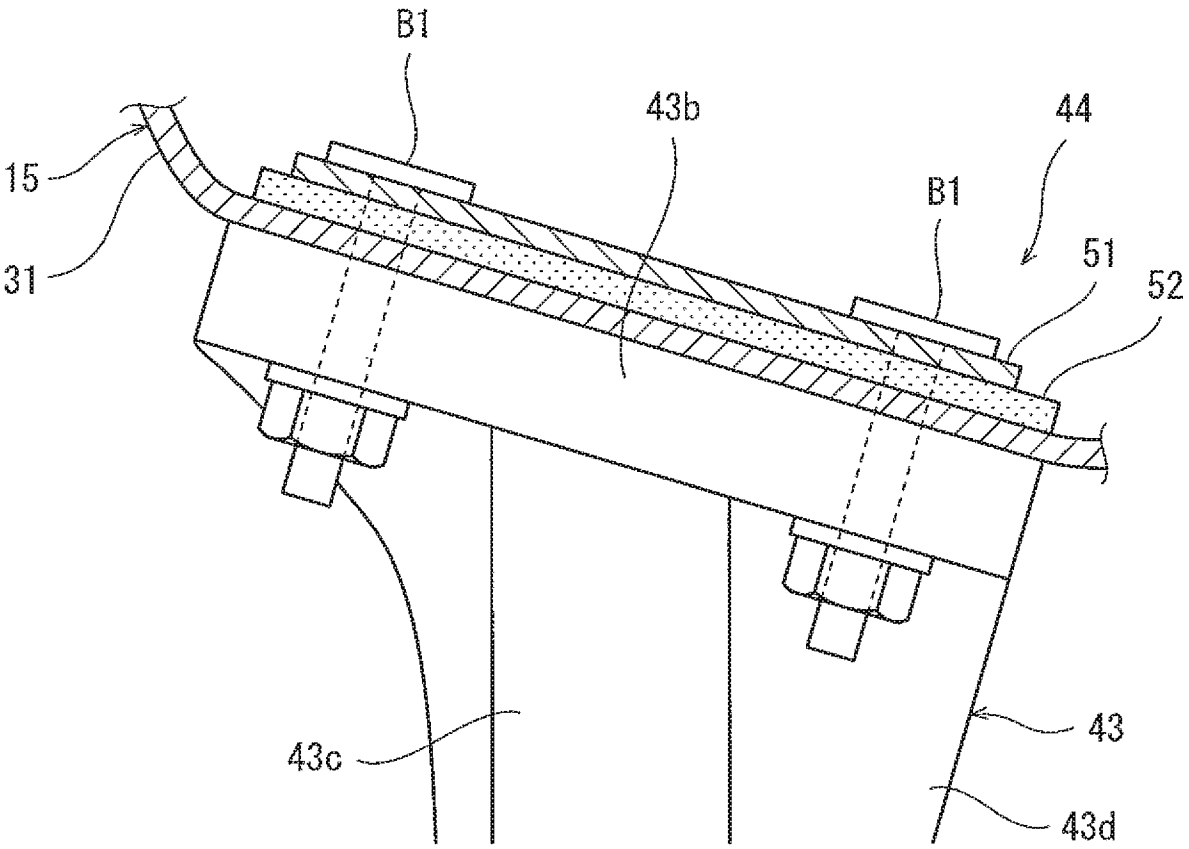
FIG. 5 is a longitudinal cross-sectional side view of a connection structure shown in FIG. 4 as that for connection between a hatch cover and a hinge device.

FIG. 5 is a longitudinal cross-sectional side view of the connection structure shown in FIG. 4 as that for connection between the hatch cover 15 and hinge device 16. As shown in FIG. 5, the fixing member 44 includes a plate 51, a buffering member 52, and fastening members B1. The plate 51 is, for example, a metal plate. The buffering member 52 is, for example, a sheet made of an elastic material (e.g., rubber or silicone). The fastening members B1 are, for example, bolts. The plate 51 is disposed in the internal space defined by the inner and outer panels 31 and 32 of the hatch cover 15 and is located closer to the upper surface of the inner panel 31 than to the lower surface of the outer panel 32.

The buffering member 52 is interposed between the plate 51 and the inner panel 31. The buffering member 52 has a larger area than the plate 51. The buffering member 52 as interposed between the plate 51 and the inner panel 31 protrudes at least forward beyond the plate 51 (in the present embodiment, the buffering member 52 protrudes outwardly from the plate 51 over the entire periphery). The fastening members B1 fasten the plate 51 to the distal end portion 43*b* of the arm member 43, with the inner panel 31 and buffering member 52 sandwiched between the distal end portion 43*b* of the arm member 43 and the plate 51.

Figure 6:
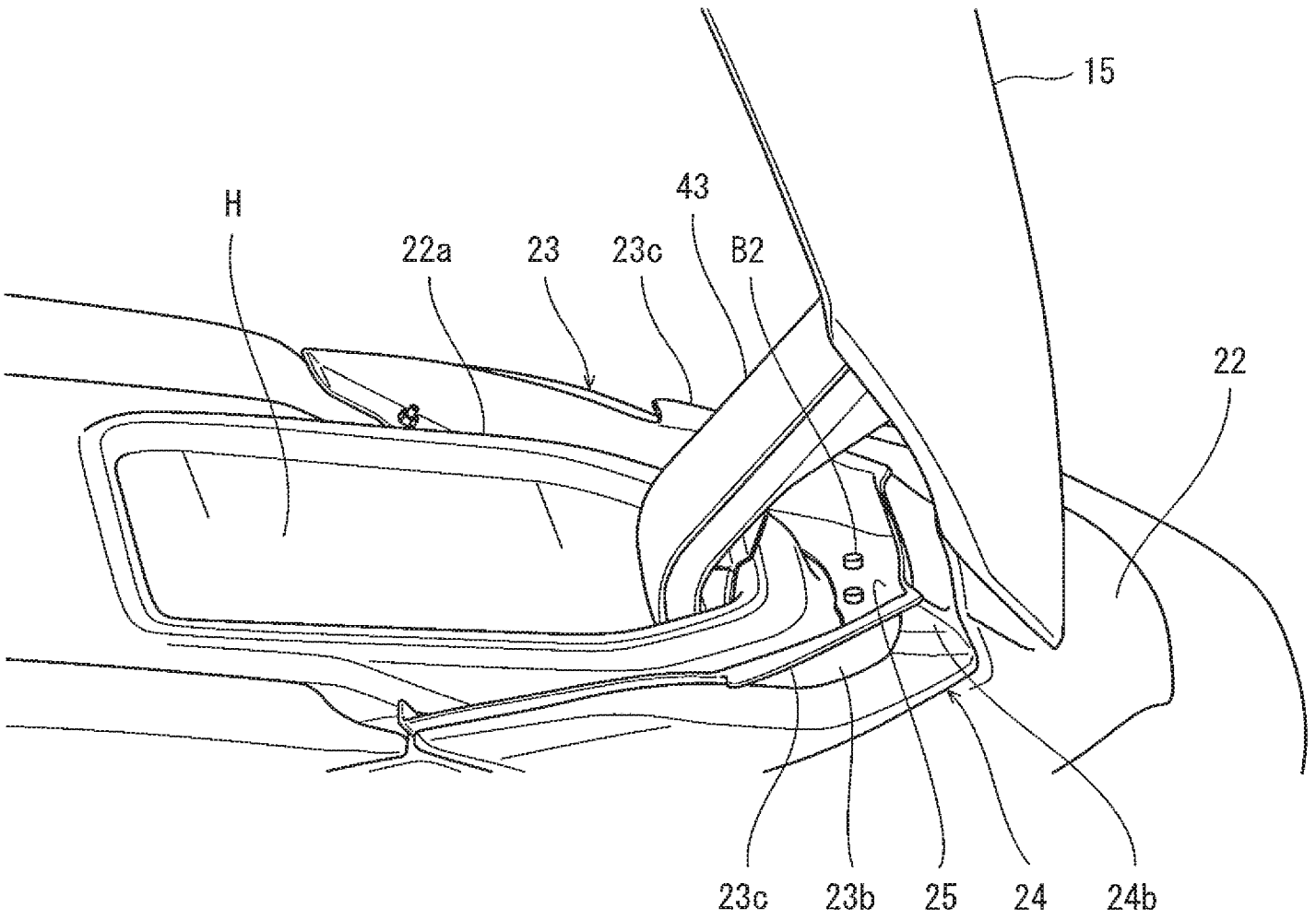
FIG. 6 is a perspective view of the personal watercraft shown in FIG. 3, where the hatch cover is opened and second sealing members and a filling member are removed.
Figure 8:
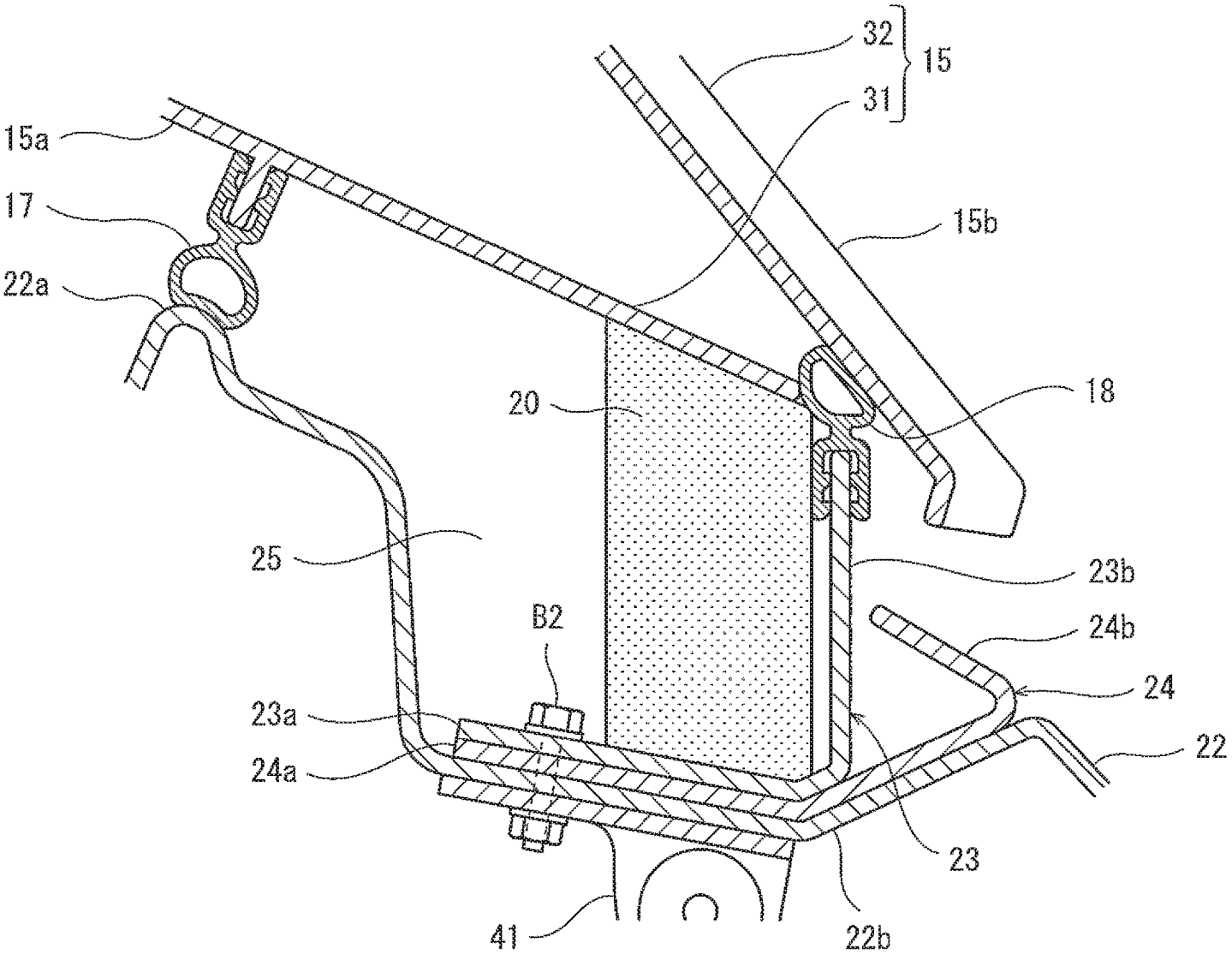
FIG. 8 is an enlarged view of the personal watercraft's key components shown in FIG. 4.
Figure 9:
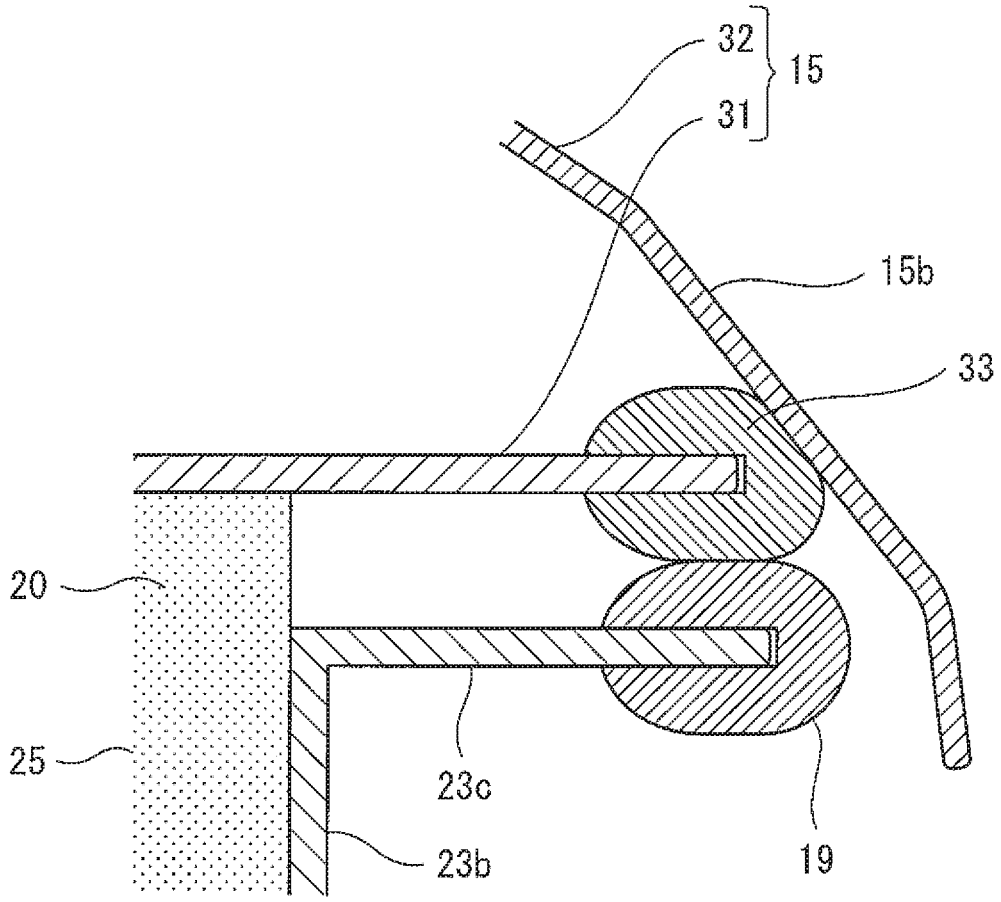
FIG. 9 shows the second sealing member and its vicinity in cross-section taken at a different location than the cross-section of FIG. 8.

FIG. 6 is a perspective view of the personal watercraft 1 shown in FIG. 3, where the hatch cover 15 is opened and second sealing members 18 and 19 and a filling member 20 are removed. FIG. 7 is a perspective view of the personal watercraft 1 shown in FIG. 6, with the second sealing members 18 and 19 and the filling member 20 mounted. FIG. 8 is an enlarged view of the personal watercraft 1's key components shown in FIG. 4. FIG. 9 shows the second sealing member 19 and its vicinity in cross-section taken at a different location than the cross-section of FIG. 8. As shown in FIGS. 6 and 8, a stepped portion 22*b* is provided in a region of the upper surface of the deck 22, the region extending laterally and forwardly from the opening H. The stepped portion 22*b* is located below the level of the peripheral portion 22*a*. A baffle member 23 and a fairing member 24 are fixed to the stepped portion 22*b* of the deck 22 by fastening members B2. The baffle member 23 and the fairing member 24 are each a plate member having a curved shape. The baffle member 23 and fairing member 24 constitute the watercraft body 2 together with the hull 21 and the deck 22.

The baffle member 23 includes a base portion 23*a* and a baffle portion 23*b*. The base portion 23*a* is placed over the stepped portion 22*b* of the deck 22 and fixed to the stepped portion 22*b*. The baffle portion 23*b* projects upward from front and lateral edges of the base portion 23*a*. A gap is formed between the baffle portion 23*b* and the hatch cover 15. The baffle portion 23*b* as viewed in plan is spaced forwardly and laterally from the peripheral portion 22*a* of the opening H and formed in a U-shape along the peripheral portion 22*a*. Thus, a recessed portion 25 which is open upward is formed between the peripheral portion 22*a* and the baffle portion 23*b* in the deck 22.

As shown in FIGS. 6 and 9, a flange portion 23*c* projects horizontally outward from a given portion of the upper edge of the baffle portion 23*b*. The flange portion 23*c* is disposed in a region where the location of the second sealing member 19 needs to be shifted forwardly and laterally relative to the baffle portion 23*b* because of the geometry of the hatch cover 15*a*. If there are no such locational restrictions, the flange portion 23*c* need not be provided. Depending on the geometry of the hatch cover, the flange portion 23*c* may be provided over the entirety of the upper edge of the baffle portion 23*b*.

The fairing member 24 includes a base portion 24*a* and a fairing portion 24*b*. The base portion 24*a* is placed over the stepped portion 22*b* of the deck 22 and fixed to the stepped portion 22*b*. The base portion 24*a* is sandwiched between the base portion 23*a* of the baffle member 23 and the stepped portion 22*b* of the deck 22. The base portion 24*a* projects forwardly and laterally from the base portion 23*a* of the baffle member 23. The fairing portion 24*b* projects from the front and lateral edges of the base portion 24*a* in such a manner as to extend back toward the baffle portion 23*b*. The upper edge of the fairing portion 24*b* is located below the level of the upper edge of the baffle portion 23*b*. The upper edge of the fairing portion 24*b* faces the periphery of the hatch cover 15 in the vertical direction.

As shown in FIG. 8, the overhanging portion 15*b* of the hatch cover 15 extends forward from the closing portion 15*a* which closes the opening H. When the hatch cover 15 is in the closed state, the overhanging portion 15*b* covers the recessed portion 25 and the baffle portion 23*b* from above. The second sealing member 18 is mounted on the upper edge of the baffle portion 23*b* of the baffle member 23. When the hatch cover 15 is in the closed state, the second sealing member 18 is in contact with the hatch cover 15 from below. Thus, when the hatch cover 15 is in the closed state, the second sealing member 18 seals the gap between the overhanging portion 15*b* and the baffle portion 23*b*.

As shown in FIG. 9, the overhanging portion 15*b* of the hatch cover 15 extends also laterally. The second sealing member 19 is mounted on the flange portion 23*c* of the baffle member 23. The hatch cover 15 is provided with a cover-side sealing member 33 and, when the hatch cover 15 is in the closed state, the second sealing member 19 is in contact with the cover-side sealing member 33 from below. Thus, when the hatch cover 15 is in the closed state, the second sealing member 19 seals the gap between the overhanging portion 15*b* and the baffle portion 23*b*. Even if, as shown in FIG. 9, the extent of overhanging of the hatch cover 15 is large with respect to the baffle portion 23*b*, the lower surface of the overhanging portion 15*b* is prevented from being exposed to water pressure.

The recessed portion 25 accommodates a filling member 20. In the present embodiment, the filling member 20 is disposed at least in a region of the recessed portion 25 that is in proximity to the baffle portion 23*b*. The filling member 20 may be large enough to occupy the entirety of the recessed portion 25. The filling member 20 is flexible. For example, the filling member 20 is a porous resin material. When the hatch cover 15 is in the closed state, the filling member 20 is in contact with the lower surface of the overhanging portion 15*b*.

With the configuration described above, for example, when the front portion of the watercraft body 2 violently plunges into water, the water coming from the front can be pushed back by the baffle portion 23*b*, and entry of the water into the recessed portion 25 through the gap between the overhanging portion 15*b* and the baffle portion 23*b* can be prevented by the second sealing members 18 and 19. Hence, exposure of the lower surface of the overhanging portion 15*b* to high water pressure can be prevented, and thus generation of a strong upward stress on the overhanging portion 15*b* can be prevented. Consequently, local deterioration of the hatch cover 15 including the overhanging portion 15*b* can be prevented.

Additionally, since the recessed portion 25 accommodates the filling member 20, entry of water into the recessed portion 25 can be blocked by the filling member 20 even if water coming from the front passes through the gap between the overhanging portion 15*b* and the baffle portion 23*b* due to, for example, deterioration of the second sealing members 18 and 19. Hence, even if the second sealing members 18 and 19 have deteriorated, exposure of the lower surface of the overhanging portion 15*b* to high water pressure can be prevented, and thus generation of a strong upward stress on the overhanging portion 15*b* can be prevented.

Additionally, when the hatch cover 15 is in the closed state, the filling member 20 is in contact with the lower surface of the overhanging portion 15*b*. As such, even if water coming from the front passes through the gap between the overhanging portion 15*b* and the baffle portion 23*b* to enter the recessed portion 25, the water can be prevented from reaching the lower surface of the overhanging portion 15*b* and applying water pressure to the lower surface. Additionally, since the filling member 20 is a flexible member, interference of the filling member 20 with the opening and closing motion of the hatch cover 15 can be prevented.

With the hinge device 16 configured as described above, the location where the distal end portion 43*b* of the arm member 43 is fixed to the hatch cover 15 by the fixing member 44 is on the closing portion 15*a* of the hatch cover 15, and thus the length from the location where the hatch cover 15 is restrained by the hinge device 16 to the free end of the overhanging portion 15*b* is large. Even in this configuration, exposure of the overhanging portion 15*b* to high upward water pressure can be prevented by the baffle portion 23*b* and the second sealing members 18 and 19, and thus local deterioration of the hatch cover 15 can be prevented.

With the fixing member 44 configured as described above, even if high water pressure acts on the inner panel 31 of the hatch cover 15 to displace the inner panel 31 relative to the plate 51, the buffering member 52 can protect the inner panel 31 from the plate 51 to prevent deterioration of the hatch cover 15.

Additionally, since the buffering member 52 protrudes at least forward beyond the plate 51, even if high water pressure acts on the overhanging portion 15*b* to displace the overhanging portion 15*b* in such a direction that an edge of the plate 51 would dig into the inner panel 31, the buffering member 52 can protect the inner panel 31 from the edge of the plate 51 to prevent deterioration of the hatch cover 15.

Additionally, in the arm member 43, the gusset portion 43*d* is disposed on that forwardly facing surface of the arm portion 43*c* which is in the vicinity of the distal end portion 43*b*. As such, even if high water pressure acts on the overhanging portion 15*b* to generate a stress on the distal end portion 43*b*, deterioration of the arm portion 43*c* can be prevented by the gusset portion 43*d*.

Additionally, since the retainer portion 43*f* of the arm member 43 can keep the hatch cover 15 in the open state, the user-friendliness in opening and closing of the hatch cover 15 can be improved. Further, since the retainer portion 43*f* is formed from a resin integrally with the arm portion 43*c*, an increase in the numbers of required components and assembly steps can be prevented while ensuring improved user-friendliness in opening and closing of the hatch cover 15.

Many modifications and other embodiments of the present invention will be apparent to those skilled in the art from the foregoing description. Accordingly, the foregoing description is to be construed as illustrative only, and is provided for the purpose of teaching those skilled in the art the best mode for carrying out the invention. The details of the structure and/or function may be varied substantially without departing from the scope of the invention.

What is claimed is:

1. A personal watercraft comprising:

a watercraft body comprising a front accommodation space positioned internally and a front portion provided with an opening through which the front accommodation space is open upward, the watercraft body further comprising a baffle portion and a recessed portion, the baffle portion being spaced at least forward from a peripheral portion of the opening and projecting upward, the recessed portion being formed between the peripheral portion and the baffle portion;

a hatch cover comprising a closing portion configured to be placed over and close the opening and an overhanging portion extending at least forward from the closing portion to cover the recessed portion and the baffle portion from above;

a hinge device coupling the hatch cover to the watercraft body so that the hatch cover is movable to open and close the opening;

a first sealing member configured to seal a gap between the peripheral portion of the opening and the hatch cover when the hatch cover is in a closed state where the hatch cover closes the opening; and a second sealing member configured to seal a gap between the overhanging portion and the baffle portion when the hatch cover is in the closed state.

2. The personal watercraft according to claim 1, further comprising a filling member accommodated in the recessed portion.

3. The personal watercraft according to claim 2, wherein the filling member is flexible, and the filling member is in contact with a lower surface of the overhanging portion when the hatch cover is in the closed state.

4. The personal watercraft according to claim 1, wherein the hinge device comprises:

a pivot member pivotally supported on a portion of an inner surface of the watercraft body, the inner surface facing the front accommodation space, the portion of the inner surface being located forward of the opening;

an arm member comprising a proximal end portion supported by the pivot member, a distal end portion attached to the closing portion of the hatch cover, and an arm portion extending from the proximal end portion to the distal end portion in the front accommodation space; and a fixing member fixing the distal end portion of the arm member to the closing portion of the hatch cover.

5. The personal watercraft according to claim 4, wherein the hatch cover comprises an inner panel facing the opening, and an outer panel placed over the inner panel in such a manner that an internal space is formed between the inner panel and the outer panel, and the fixing member comprises a plate disposed in the internal space and located closer to an upper surface of the inner panel than to a lower surface of the outer panel, a fastening member fastening the plate to the distal end portion, with the inner panel sandwiched between the plate and the distal end portion, and a buffering member interposed between the plate and the inner panel.

6. The personal watercraft according to claim 5, wherein the buffering member protrudes at least forward beyond the plate.

7. The personal watercraft according to claim 4, wherein the distal end portion projects at least forward from the arm portion, and the arm member further comprises a gusset portion connecting a forwardly facing surface of the arm portion to the distal end portion, the forwardly facing surface being in a vicinity of the distal end portion.

8. The personal watercraft according to claim 4, wherein the arm member further comprises a retainer portion configured to be engaged with the peripheral portion to keep the hatch cover in an open state when the hatch cover is opened to a predetermined position.

9. The personal watercraft according to claim 8, wherein the retainer portion is formed from a resin integrally with the arm portion.

* * * * *